United States Patent [19]

Perryman

[11] Patent Number: 4,928,535

[45] Date of Patent: May 29, 1990

[54] METHODS AND APPARATUS FOR MEASURING SKI BOOT BINDING TORQUE

[75] Inventor: John S. Perryman, Kinnelon, N.J.

[73] Assignee: Oshman's Sporting Goods, Inc., Houston, Tex.

[21] Appl. No.: 317,091

[22] Filed: Feb. 21, 1989

Related U.S. Application Data

[63] Continuation-in-part of Ser. No. 255,125, Oct. 7, 1988, abandoned.

[51] Int. Cl.[5] ..... G01L 5/03

[52] U.S. Cl. ..... 73/862.02

[58] Field of Search ..... 73/862.02

[56] References Cited

U.S. PATENT DOCUMENTS

| | | |
|---|---|---|
| 3,192,767 | 7/1965 | Outwater . |
| 3,274,827 | 9/1966 | Sturtevant . |
| 3,572,105 | 3/1971 | Kaehler . |
| 3,805,603 | 4/1974 | Ettlinger . |

FOREIGN PATENT DOCUMENTS

| | | | |
|---|---|---|---|
| 293923 | 12/1971 | Austria | 73/862.02 |
| 3147142 | 7/1982 | Fed. Rep. of Germany | 73/862.02 |
| 637212 | 7/1983 | Switzerland | 73/862.02 |

OTHER PUBLICATIONS

"CDI Multipliers & Dial Wrenches" discloses a dial--type torque wrench.

"1987-1988 Release Calibrater Operations and Maintenance Manual," published by Vermont Ski Safety Equipment, Inc.

"ASTM Designation: E 74-83 Standard Practice of Calibration of Force-Measuring Instruments for Verifying the Load Indication of Testing Machines," (1983).

"Salomon 1987/88 Adjustment Chart".

"Classify Yourself for Skier Type".

"Bindings '88," Skiing Trade News, Feb. 1988, pp. 57-60.

"New and Notable," Skiing Trade News, Mar. 1988, p. 154.

*Primary Examiner*—Charles A. Ruehl

*Attorney, Agent, or Firm*—Vaden, Eickenroht, Thompson & Boulware

[57] ABSTRACT

Methods and apparatus for measuring binding release torque. In one embodiment the apparatus (10) has a foot member (12) having a movable toe member (14) connected thereto which can, upon insertion into footwear (46), accommodate footwear of different sizes and types. A leg bar (16) extends upwardly from the foot member (12) and is secured thereto for bearing lateral and vertical torques for testing bindings. The leg bar (16) is provided with a recess (22) for receiving a torque measuring apparatus such as a torque wrench and a strap or connector (42) attached to the leg bar (16) encompasses the sole of the footwear (46) emplaced in the bindings (48, 50) to be tested. The methods and apparatus are also suitable for testing ski boot bindings.

16 Claims, 2 Drawing Sheets

METHODS AND APPARATUS FOR MEASURING SKI BOOT BINDING TORQUE

This application is a continuation-in-part of co-pending application Ser. No. 255,125, filed on Oct. 7, 1988, now abandoned.

BACKGROUND OF THE INVENTION

1. Field of the Invention

The present invention is directed to methods and apparatus for measuring the release force of ski boot bindings and particularly to methods and apparatus for measuring the torque necessary to effect the release of a pre-set ski-boot-binding system.

2. Description of the Prior Art

Ski boots are generally releasably secured to skis so that the boots are released when a certain level of torque in a particular direction is reached. This releasable securement is effected by releasable ski boot safety bindings which hold the boot toe and boot heel until the pre-set torque level is reached. In this manner the ski boot is held securely during normal skiing, but is released to reduce the risk of injury to the skier upon the application of abnormally high torque levels.

Injuries can result from bindings which are set either too loosely or too tightly. Many efforts have been made to provide devices for accurately measuring the torque-release setting of bindings so that for a particular skier the bindings are set within an appropriate range. A variety of problems have been encountered with these prior art efforts. For example, the prior art devices cannot be set accurately within a sufficiently narrow range of torque measurement to provide an appropriate binding setting for a person of a particular height, weight, and skiing ability. Other prior art devices are unnecessarily complex and, consequently, difficult to use and even more difficult to use accurately. Some prior art devices require extra extensions to allow persons of limited strength or stature to apply the necessary test torque to check a pre-set binding. Both toe and heel bindings must be checked; therefore an appropriate measuring apparatus must be able to make each type of measurement conveniently and with a minimum of re-orientation. To further complicate the measurement of pre-set binding release torques, skiers' feet differ (primarily in length) so skiers' boots differ. A device for measuring pre-set binding torque should be able to easily and readily accommodate the differences in boot sizes. Finally, the device to be used in testing should be held firmly in place during testing without adding additional resistance—a function not always properly accomplished by prior art devices.

In accordance with 37 C.F.R.§1.56 the following are disclosed:

| U.S. Pat. Nos. | |
|---|---|
| 3,805,603 | Device for measuring forward bend resistance of ski bindings to determine release setting using a simulated foot insert, the device connectible to a ski and the foot insertable into a boot which is also connected to the ski for testing. A lever arm extends from the foot for connection to a torque indicating tool. Torsion settings of toe bindings can also be measured with the device. |
| 3,572,105 | Apparatus for testing the torque force required to release a ski boot from a releasable binding, the apparatus having a foot body for insertion into a boot which is mounted on a ski and bound at the toe with a releasable binding. The test forces are applied with a conventional torque wrench. |
| 3,274,827 | A conventional torque wrench. |
| 3,192,767 | A torque measuring device for use with a toe binding on a ski. The device has a last for internally engaging the boot to which is connected a conventional torque wrench to test the release force of the toe binding. |

PUBLICATIONS

"CDI Multipliers & Dial Wrenches" discloses a dial-type torque wrench [face of wrench states "Pat. No. 3726134 Pat. Pend."]

"1987–88 Release Calibrater Operations and Maintenance Manual," published by Vermont Ski Safety Equipment, Inc.

"ASTM Designation: E 74–83 Standard Practice of Calibration of Force-Measuring Instruments For Verifying The Load Indication of Testing Machines" (1983).

"Salomon 1987/88 Adjustment Chart".

"Classify Yourself For Skier Type".

"Bindings '88," Skiing Trade News, February 1988, pages 57–60.

"New and Notable," Skiing Trade News, March 1988, page 154.

Of particular concern in setting binding release forces is the setting of the release force in a sufficiently narrow range for a person of a particular size. But a review of so-called acceptable settings with prior art devices discloses an unacceptably broad range for settings; i.e., a setting in the accepted broad range may indeed be inappropriate for a particular skier. For example in the "Verification Chart" on page x6 of the 1987–88 Release Calibrater Operations and Maintenance Manual for a test weight of two pounds and a "UNIV." category, the acceptable range is "0.2–0.7". This range is a variance of ±56%.

There has long been a need for an accurate apparatus and method for testing the torque release settings of ski bindings. There has long been a need for devices and methods directed to testing of both toe and heel bindings. There has long been a need for a device for testing ski bindings which can be used easily, conveniently, and accurately. There has long been a need for such devices which can firmly grip the boot to be tested and yet which can easily and conveniently be removed from the boot. There has long been a need for devices and methods for testing the torque release settings of ski bindings which can accommodate feet of different sizes. There has long been a need for a device which can be used by an operator who need not pay special attention to the resistive forces applied by the operator's hand during the testing. The present invention recognizes, addresses, and satisfies these long-felt needs as well as others to be discussed below.

SUMMARY OF THE INVENTION

The present invention is directed to methods and apparatus for accurately testing or measuring the release torques of ski boot bindings. In one embodiment an apparatus according to the present invention includes a foot member having connected thereto a movable toe member which is movable to accommodate boots of different sizes and types. The toe member is preferably biased away from the foot member by suitable springs. A leg bar extends upwardly from the foot member and is secured to the foot member in such a fashion as to bear the necessary lateral and vertical torques for testing the boot bindings. The leg bar has appropriate fixtures or openings for connecting thereto a torque measuring tool such as a conventional torque wrench for applying torque laterally, forward and back. A strap or other connection means holds the leg and goes around the sole of the boot which is emplaced in the bindings to be tested to stabilize the apparatus on the boot. In one embodiment of the present invention this holding strap is secured to a clamp on the leg bar which is movable on the leg bar to effect a tight strap condition which is, nevertheless, rotatable with minimum frictional loss. This clamp may be spring-loaded for easy one-hand linear movement and adjustment. The rotatable clamp may be used by the operator to hold the leg bar straight without added frictional resistance. The leg bar is provided with means for receiving a torque measuring apparatus. In one embodiment, that receiving means takes the form of a separate fixture secured to the top of the leg bar that is provided with recesses therein for receiving and holding the end of a torque wrench for testing both lateral (torsional-toe) torque and forward/backward (bending-heel) torque. Such a separate fixture provides ease of manufacture of the leg bar. This separate fixture can be welded or pinned to the leg bar. By using a conventionally available dial-type torque wrench, a tester can set the dial to the likely area of a measurement and she or he can also use one of the dial indicators to mark one reading before taking another. Also, since the indicating needles are enclosed behind a clear shield, they are protected from inadvertent changes of position.

It is therefore an object of the present invention to provide new, useful, and unobvious apparatuses for testing the release torque of a ski binding.

It is also an object of the present invention to provide new, useful, and unobvious methods for testing the release torque of a ski binding.

Another object of the present invention is the provision of such methods and apparatuses for testing ski bindings.

Yet another object of the present invention is the provision of such methods and apparatuses which result in accuracies commensurate with the torque wrench used.

A further object of the present invention is the provision of such methods and apparatuses employing a member for accommodating boots of different size and style.

An additional object of the present invention is the provision of such methods and apparatuses employing a strap for holding a boot sole to an upwardly extending leg bar which is connected to a foot member which is inserted into a boot, which boot is bound to a ski by the bindings to be tested.

A particular object of the present invention is the provision of such methods and apparatuses in which the strap is connected to a clamp on the leg bar which is easily adjustable and movable linearly along the leg bar.

An additional object of the present invention is the provision of such methods and apparatuses in which the clamps to which the strap is connected may act as a journal bearing on the leg bar such that operative resistive forces are minimized while reaction to side force is maximized.

Another object of the present invention is the satisfaction of the long-felt needs previously discussed herein.

To one of skill in this area who has the benefit of this invention's teachings, other and further objects and advantages, as well as more inherent therein, will be clear from the following description of presently-preferred embodiments of the invention, given for the purpose of disclosure, where taken in conjunction with the drawing described below.

The following disclosure is offered for public dissemination in return for the grant of a patent. Although it is detailed to ensure adequacy and aid understanding, this is not intended to prejudice the appended claims' coverage of other embodiments no matter how others may later disguise them by variations in form or additions or further improvements. The claims at the end hereof are intended as the chief aid toward this purpose, as it is these that meet the requirement of claiming the invention.

DESCRIPTION OF PRESENTLY PREFERRED EMBODIMENTS

Figure 2:
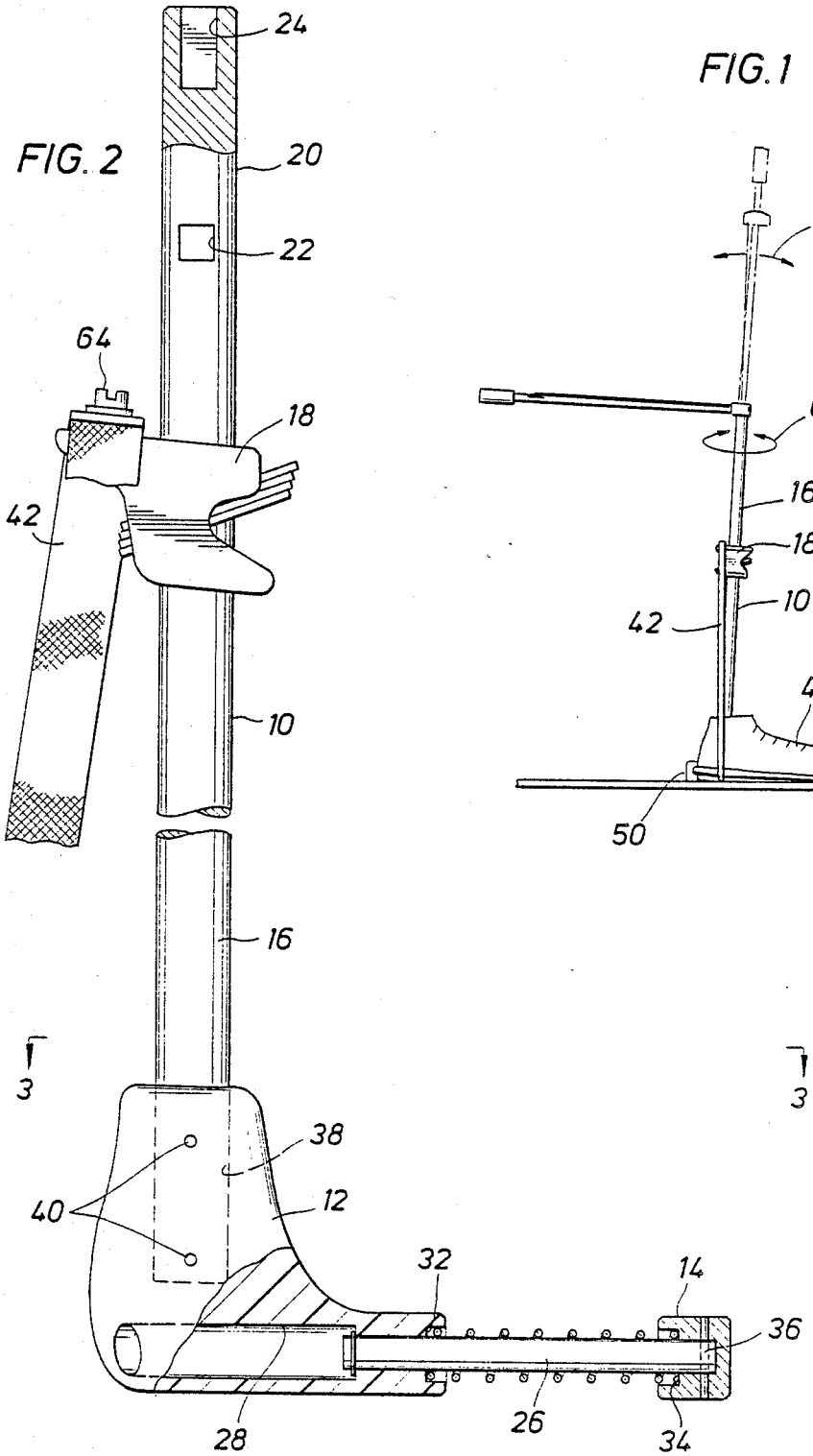
FIG. 2 is a side view, partially in cross sectional, of an apparatus according to the present invention.
Figure 1:
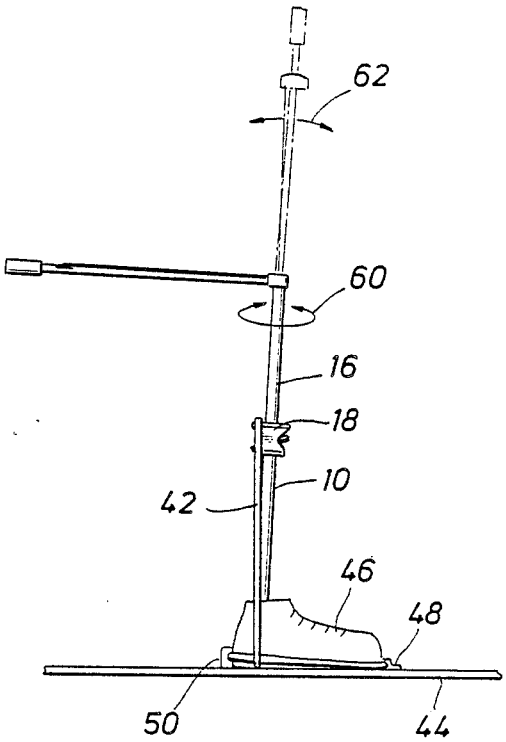
FIG. 1 is a side view of an apparatus according to the present invention illustrating its use in a method according to the present invention.
Figure 3:
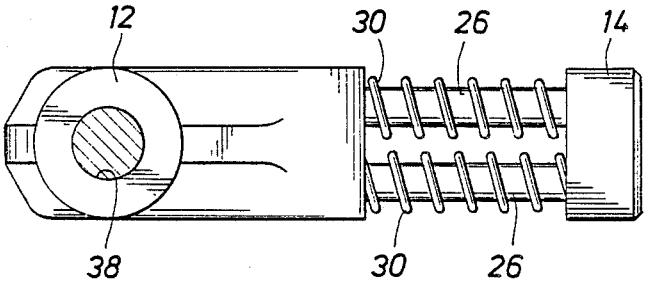
FIG. 3 is a bottom view along, line 3—3 of FIG. 2 of the apparatus of FIG. 2.

A ski binding torque release testing tool 10 according to the present invention is shown in FIGS. 1–3. The device 10 has a foot 12, a toe 14 movably connected to the foot 12, and a leg 16 secured to the foot 12. A movable strap clamp 18 (commercially available prior art clamp) is disposed about the leg 16 and is easily movable on the leg 16. Means, in the form of block 20 secured to the top of the leg 16 having openings or recesses therein (22, 24), for receiving and holding a projection on a conventional torque wrench.

The toe 14 of the foot 12 is connected to mounting rods 26 which are movably disposed in channels 28 in the foot 12 (of course only one or more than two rods way be used). A spring 30 biases each rod 26 outwardly from the foot 12 so that the foot-12-toe-14 combination will accommodate a range of foot lengths and sizes; typically a range of junior size 1 to adult size 13.

The springs 30 abut a foot shoulder 32 on the foot 12 and a toe shoulder 34 on the toe 14. The rods 26 are shown as secured by a pin 36 extending through both the toe 14 and the rod 26. The leg 16 is secured to the foot 12 within a channel 38 in the foot 12 by pins 40. Although the rods 26 are movable linearly, the foot-toe combination is rigid in both horizontal and vertical planes.

A strap 42 extends from the strap clamp 18 to and around a boot 46, which is bound by a toe binding 48 and a heel binding 50, to stabilize the tool 10 on boot 46. A bolt (or bolts) 44 secures the strap 42 to the clamp 18.

Figure 4B:
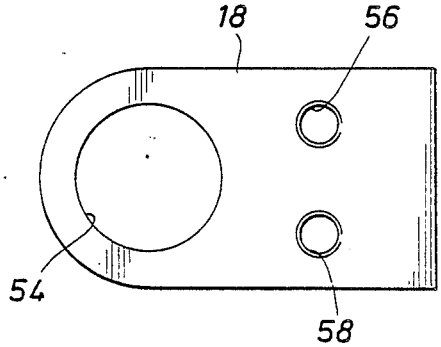
FIG. 4*b* is a top view of the clamp of FIG. 4*a*.
Figure 4A:
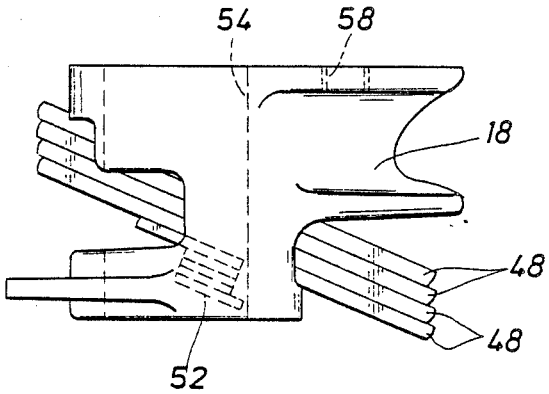
FIG. 4*a* is a side view of a strap clamp useful with the present invention.

The clamp 18 is shown in FIGS. 4*a* and 4*b*. The clamp 18 has a hole 54 for mounting about the leg 16 and a plurality of movable bars 48 which are biased by a spring 52 so that the bars 48 bear against the leg 16 to hold the clamp 18 in place linearly on the leg 16 while allowing rotational freedom. With a single hand a tester can move the bars 48 against the spring 52 disengaging them from the leg 16 and thereby rendering the clamp 18 movable linearly on the leg 16. In this manner the strap 42 can be tightened about the boot 46 as desired using the screw 64 mounted to clamp 18. Tapped holes 56, 58 shown in FIG. 4*b* secure the strap 42 to be secured to the clamp 18 by the screws.

Ski bindings are usually coupled with spring-loaded members. It is the torque force holding these members which must be overcome to release the bindings. In a method according to the present invention a tool such as the tool 10 is emplaced in a bound boot such as the boot 46 (FIG. 1). The toe 14 touches the inner wall of the boot and the rods 26 move to permit the foot 12 to enter and rest completely in the boot 46, as well as to bridge the forward lean fulcrum of the system. The rods 26 and spring 30, 32 insure that the foot and toe are firmly, rigidly in place within the boot 46. To test the toe binding 48, the end of a torque wrench is inserted into the wrench recess 24 of the block 20 and the wrench is turned in the direction 60 until the binding is released. The operator holds the clamp 18 with one hand to react the side force without resisting the torque. The torque reading is noted. The dial-type torque wrench with a memory indicator is very useful for use with this method because the memory pointer of such a torque wrench accurately indicates the torque achieved for later recordation. It is preferred that three readings be taken and that the middle of the three readings be the reading used as the release torque of the tested binding. For bindings which have their own indicated settings, this test can confirm the accuracy of those settings.

To test the heel binding 50, the end of the torque wrench is inserted into the wrench recess 22 of the block 20 in line with the leg 16 and wrench is raised in direction 62 until the heel binding is released. Again the release torque is noted and multiple readings are taken. It is preferred that the middle reading of three readings be used as the release torque reading. It is also preferred that a conventional floating handle be used on the torque wrench so that the tester in effect pulls the wrench at the same lever point each time. A methhod according to this invention is accurate within the accuracy of the torque wrench used; e.g. with a dial-type torque wrench, accuracy is within ±2%.

It is preferred that the foot-12-toe-14 combination be sized to accommodate feet of sizes from Junior 1 to Adult 13. Of course to accomodate smaller or larger foot sizes additional foot-toe combinations can be used. Since the foot-12-toe-14 combination is vertically and horizontally rigid but variable in length, more accurate readings can be obtained than those resulting from the use of prior art devices which employ a fixed length foot that may not bridge the forward lean fulcrum.

It is understood that although the preferred embodiments described herein have two wrench recesses, it is within the scope of this invention to provide a tool with one or more than two wrench recesses or with other structure for receiving and holding a torque wrench. It is also within the scope of present invention to provide a tool for testing only toe bindings or only heel bindings.

Thus, it is seen that the apparatuses and methods of the present invention readily achieve the ends and advantages mentioned as well as other inherent therein. While certain preferred embodiments of the present invention have been described and illustrated for the purposes of disclosure, it will be clear to one of skill in this art who has the benefits of this invention's teachings that changes in the arrangement and construction of parts and steps may be made which changes are embodied within the spirit and scope of the present invention as claimed below. It is intended that each element or step recited in any of the following claims and each combination of elements is to be understood as referring to all equivalent elements or equivalent combinations for accomplishing substantially the same results in substantially the same or equivalent manner.

I claim:

1. A device for testing the release torque of a ski binding holding a boot, the device comprising:

a foot, a toe movably connected to the foot for accommodating ski boots of different size, a leg secured to and extending upwardly from the foot, a clamp disposed about the leg and movable therealong for tightly securing a strap around a ski boot in which the foot is positioned to stabilize the leg in the ski boot, and means in the leg for receiving and bolding a torque measuring apparatus.

2. The device of claim 1 wherein the toe has one or more rods secured to the toe and each rod extends from the toe into a channel in the foot, the one or more rods disposed for movement in one of the channels.

3. The device of claim 2 wherein a spring abuts the foot and the toe to push them apart from each other.

4. The device of claim 1 wherein the torque measuring apparatus receiving means comprises a wrench recess.

5. The device of claim 1 wherein the clamp is pivotably disposed about the leg.

6. A device for testing the release torque of a ski binding holding a boot, the device comprising a foot, a toe movably connected to the foot for accommodating boots of different size, the toe having one or more rods secured to the toe, each rod extending from the toe into a channel in the foot, the one or more rods disposed for movement in one of the channels, each of the one or more rods is encircled by a spring and each spring abuts the foot and the toe to push them apart, a leg secured to and extending upwardly from the foot, the leg having means formed therein for receiving and holding a torque measuring apparatus, and a strap secured to a clamp, the clamp movably and securably disposed on the leg, the strap extendable about and around the boot to stabilize the leg in the boot.

7. A method for testing the release torque of a ski binding holding a boot comprising:

emplacing the foot of a testing tool comprised of a foot having a leg and a toe mounted thereto within a ski boot;

biasing the toe of the foot outwardly from the foot that engagement with the inner wall of the ski boot to establish a foot-toe combination that is rigid in both horizontal and vertical directions in the ski boot;

positioning the ski boot in the bindings to be tested;

extending a strap secured to a clamp disposed around the leg of the testing tool around the ski boot in the bindings;

stabilizing the tool in the ski boot by sliding the clamp along the leg of the testing tool to tighten the strap around the ski boot;

engaging the leg of the testing tool with a torque measurement device; and turning the torque measurement device until the ski boot is released from the binding.

8. The method of claim 7 additionally comprising holding the clamp to react the side force resulting from turning the torque measurement device without resisting the torque.

9. The method of claim 7 including also the step of recording the binding release torque.

10. The method of claim 7 wherein the torque measurement device is a torque wrench.

11. The method of claim 10 wherein the torque measurement device is a dial-type torque wrench.

12. A device for testing the release torque of a ski binding holding a boot, the device comprising a foot;

a toe movably connected to the foot for accommodating boots of different size, said toe being secured to one or more rods extending from the toe into a channel in the foot, the one or more rods disposed for movement in one of the channels and having a spring abutting the foot and the toe and encircling one of the one or more rods to push the foot and toe apart from each other;

a leg secured to and extending upwardly from the foot; and the leg having means therein for receiving and holding a torque measuring apparatus.

13. The device of claim 12 additionally comprising a movable clamp disposed about the leg and having a strap secured thereto for stabilizing the leg in the boot.

14. A device for testing the release torque of a ski binding holding a boot, the device comprising a foot;

a toe movably connected to the foot by one or more rods extending from the toe into a channel in the foot and having a spring abutting the foot and encircling the one or more rods to push the toe and the foot apart for accommodating boots of different size;

a leg secured to and extending upwardly from the foot; and the leg having a recess therein for receiving and holding a torque measuring apparatus.

15. The device of claim 14 additionally comprising a clamp disposed about the leg and movable therealong for tightly securing a strap around a boot in which the foot is positioned to stabilize the leg in the boot.

16. The device of claim 15 wherein the clamp is pivotably disposed about the leg.

* * * * *